US007850154B2

(12) United States Patent
Feuge

(10) Patent No.: US 7,850,154 B2
(45) Date of Patent: Dec. 14, 2010

(54) ASSEMBLY FOR CLAMPING A WORKPIECE

(76) Inventor: Robert Feuge, 302 N. Acorn, Fredericksburg, TX (US) 78624

( * ) Notice: Subject to any disclaimer, the term of this patent is extended or adjusted under 35 U.S.C. 154(b) by 741 days.

(21) Appl. No.: 11/879,860

(22) Filed: Jul. 19, 2007

(65) Prior Publication Data

US 2009/0020935 A1 Jan. 22, 2009

(51) Int. Cl.
*B25B 5/00* (2006.01)

(52) U.S. Cl. ..... 269/6; 269/3

(58) Field of Classification Search ..... 269/6, 269/3, 249, 148, 166–171.1
See application file for complete search history.

(56) References Cited

U.S. PATENT DOCUMENTS 1,700,334 A * 1/1929 Puterbaugh ..... 269/215
7,093,828 B2 * 8/2006 Murray et al. ..... 269/6
7,484,310 B2 * 2/2009 Jaffers et al. ..... 33/613
2005/0082730 A1 * 4/2005 Murray et al. ..... 269/166
2006/0043661 A1 * 3/2006 Nardozza ..... 269/166
2007/0216078 A1 * 9/2007 Jaffers et al. ..... 269/37
2009/0020935 A1 * 1/2009 Feuge ..... 269/164

* cited by examiner

*Primary Examiner*—Lee D Wilson
(74) *Attorney, Agent, or Firm*—Jackson Walker, LLP

(57) ABSTRACT

An assembly for clamping a workpiece, the workpiece comprised of two pieces. The assembly includes a clamp having an L-shaped member. The L-shaped member has a leg and foot portion. The clamp also has an upright extending generally perpendicularly to the leg and the upright has a threaded portion. The clamp includes a threaded adjuster having a head, a threaded body, and a base. The base includes outer walls defining a polygon shape and handle. The handle has removed ends thereon. The handle has outer walls and inner walls, the inner walls are dimensioned to removably, slideably and snugly engage the outer walls of the base. The handle has more than one set of walls and so can be positioned to apply different torque to the base. A drill, a drill bit, and a socket may also be included in the assembly, to engage the handle and drive the threaded adjuster.

20 Claims, 5 Drawing Sheets

ASSEMBLY FOR CLAMPING A WORKPIECE

FIELD OF THE INVENTION

Assembly for clamping a workpiece, more specifically an assembly, typically comprising a clamp, a drill bit, and a socket, that will rapidly apply compression to a workpiece such as two pieces of wood being glued together.

BACKGROUND OF THE INVENTION

Clamps are used, typically, to apply compression to a workpieces. For example, it is well known to use F-clamps or C-clamps to apply compression to a workpiece, the workpiece comprising two or more pieces of a material, such as wood. In the assembly of wood products, such as furniture, for example, clamps such as C-clamps can be used to hold two or more pieces together, which pieces have been glued, while the glue is setting.

Often, many clamps are required to glue an article together. Prior art clamps require manual closing which is often time consuming.

SUMMARY OF THE INVENTION

Applicant provides an assembly for clamping a workpiece, for example, two pieces of wood, together. The assembly includes a clamp. The typical clamp includes an L-shaped member, which L-shaped member has a leg portion and a foot portion. The clamp typically has an upright extending generally perpendicular to the leg, the upright including a threaded portion. The clamp includes a threaded adjuster, typically an elongated member having a head, a threaded body, and a base. The body threadably and adjustably engages the threaded portion of the upright.

Turning now to the threaded adjuster, Applicant's invention typically includes a threaded adjuster having a body, a base, and a head. The threaded adjuster typically engages the threaded portion of the upright so that its longitudinal axis is parallel to the leg portion of the L-shaped member. The base of Applicant's threaded adjuster is typically elongated and polygonal with the handle removably engaged to the polygon which handle slidably engages the polygon of the base with walls shaped to fit snuggly adjacent the polygon.

It is seen with respect to FIG. 1 that the upright member may be slidably and lockingly engaged with leg 18. However, in an alternate preferred embodiment, leg 18 and upright 22 may be integral.

Applicant's invention further includes a handle whose inner walls are dimensioned to receive a polygon along the longitudinal axis of the handle, and/or one or more inner walls in the handle that are perpendicular to the longitudinal axis of the handle.

Applicant's invention allows for slidable removal of the handle with the polygonal shaped base such that the handle is aligned longitudinally with the base or may be removed and placed so such longitudinal axis is perpendicular to the base while allowing engagement of the handle with the base and rotation of the threaded adjuster to the perpendicular alignment of the handle with respect to the base.

Applicant's invention further includes the dimensioning of the base to accommodate a socket, such as a six-sided socket, for example, a half-inch socket. Thus, Applicant's invention provides for the removal of the handle from the base of the threaded adjuster, which removal provides access for a drill, bearing a socket, to engage the base, and thus electrically rotate, for or aft the threaded adjuster, allowing rapid securing of the workpiece between the removed end of the foot portion between the foot portion of the L-shaped member and the head of the threaded adjuster.

BRIEF DISCUSSION OF THE DRAWINGS

DETAILED DESCRIPTION OF THE PREFERRED EMBODIMENT

Figure 1:
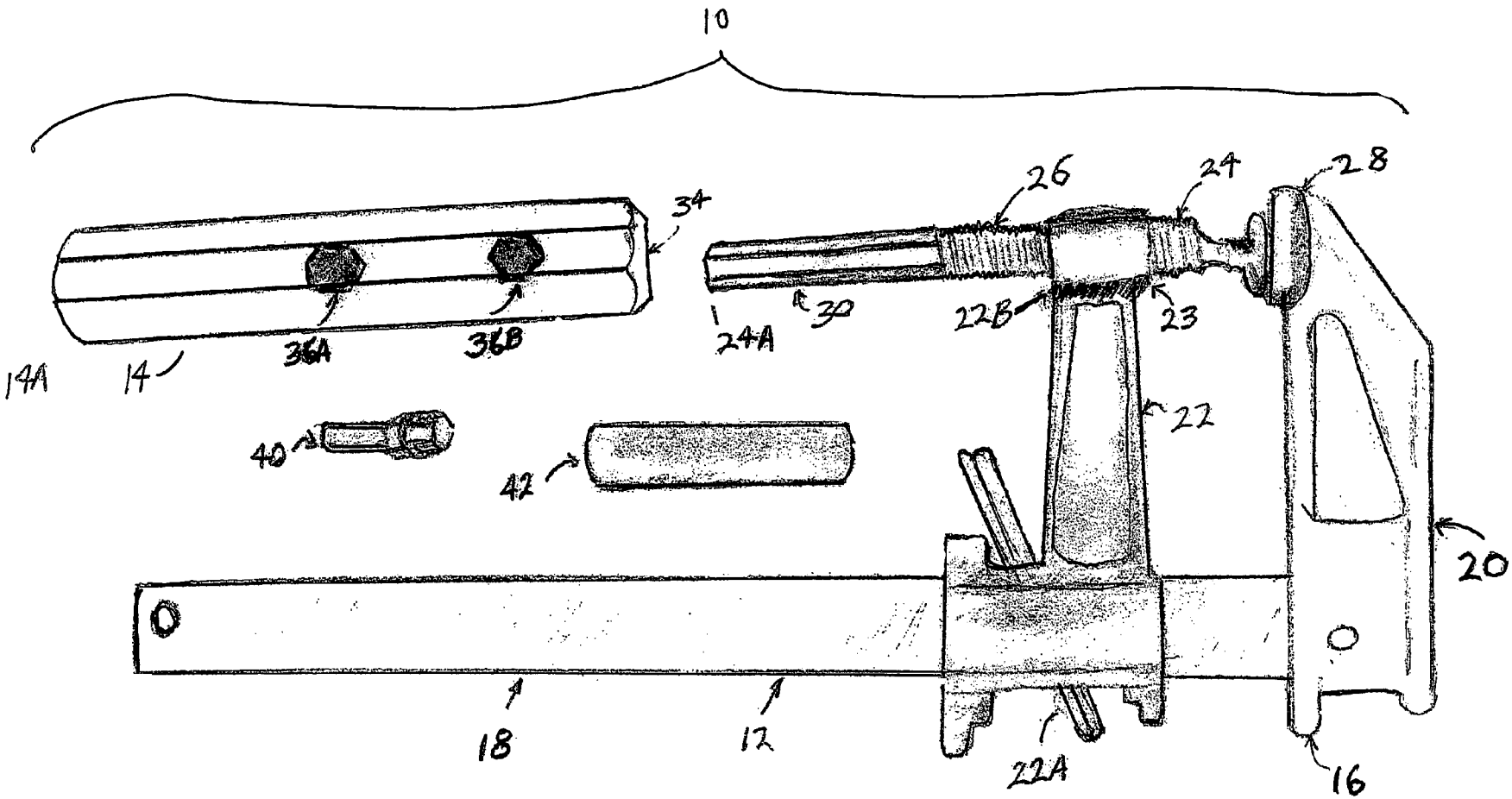
FIG. 1 is side elevational view of Applicant's assembly for clamping a workpiece, with the threaded adjuster in a closed position.
Figure 2:
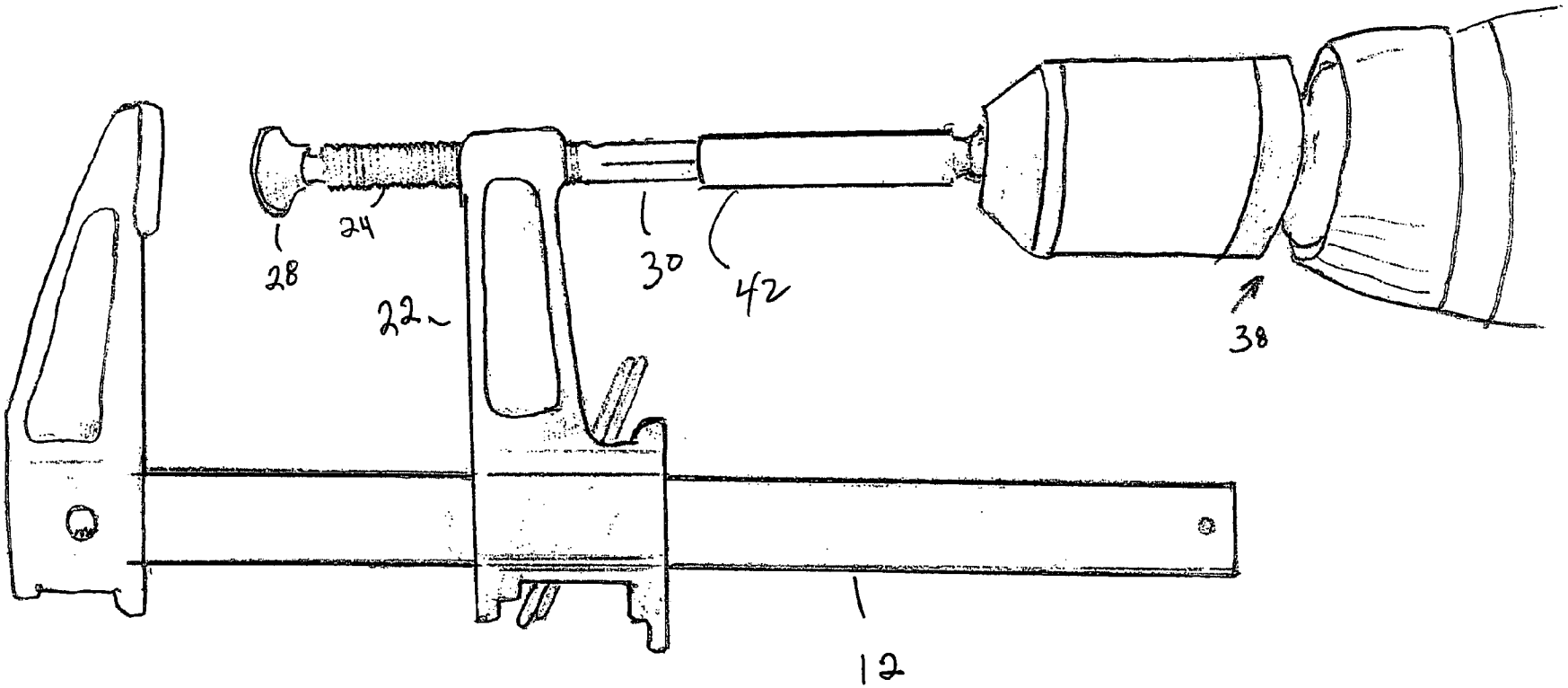
FIG. 2 is side elevational view of Applicant's assembly as includes a cordless drill and socket illustrating the manner in which a cordless drill and socket engages the base of the threaded adjuster.
Figure 3:
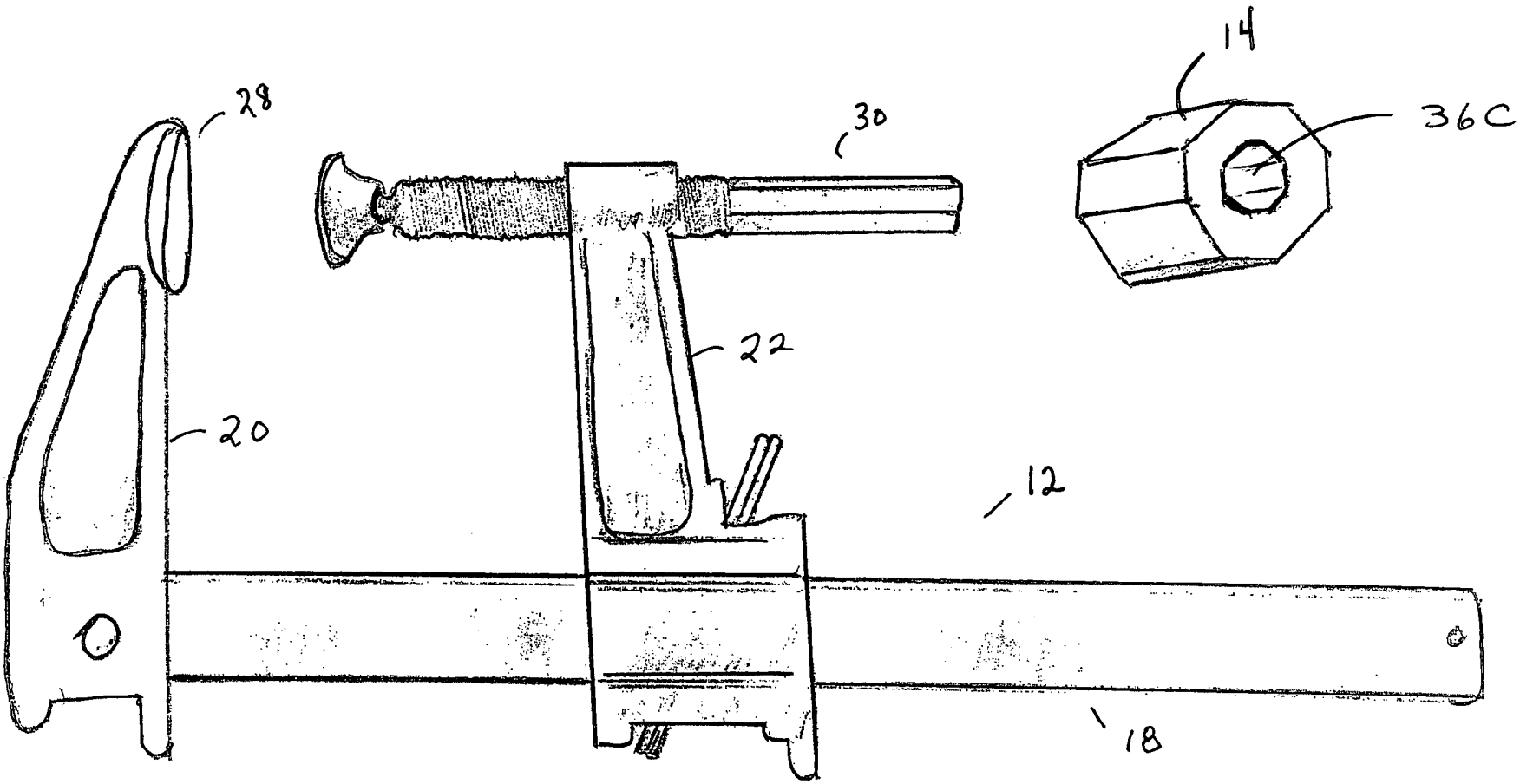
FIG. 3 is a view of Applicant's novel clamping assembly showing an end view and perspective of the handle.
Figure 4:
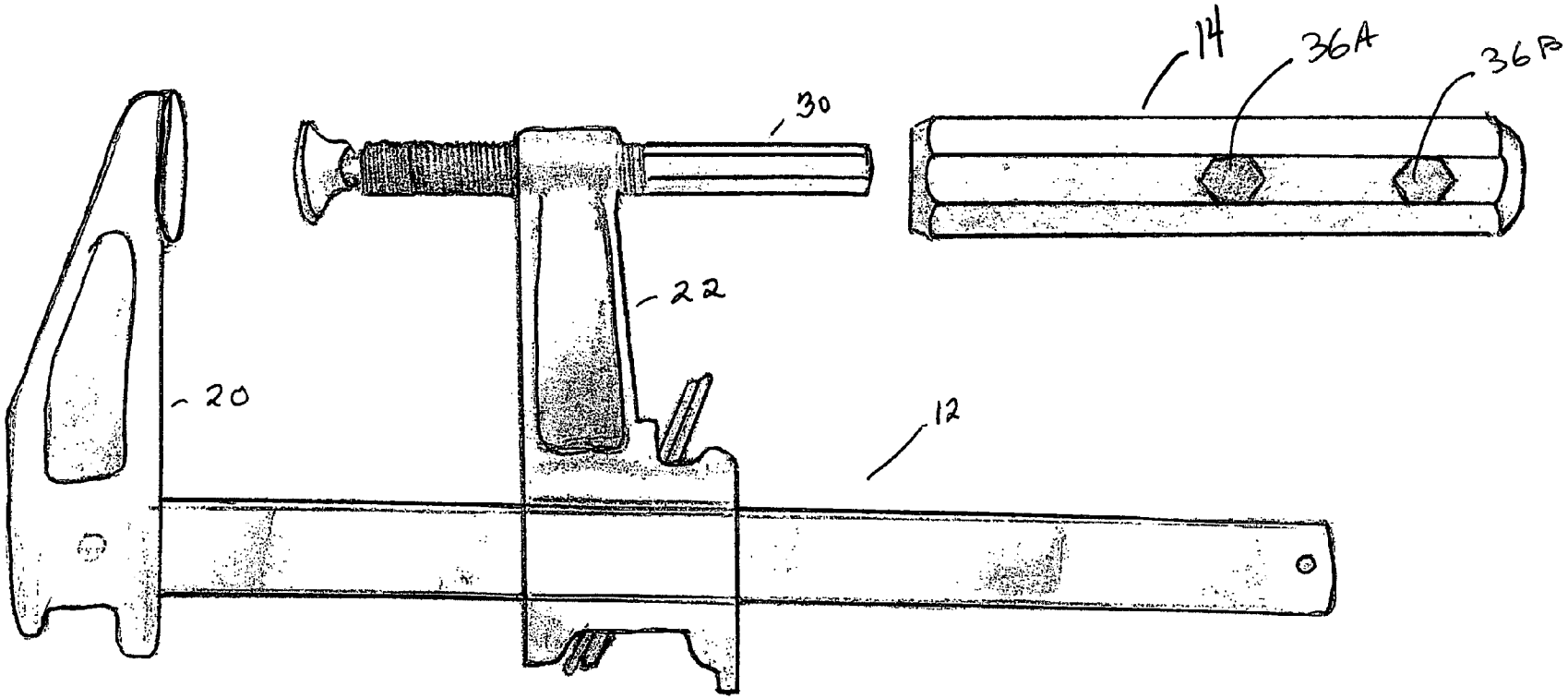
FIG. 4 illustrates a side elevational view showing Applicant's handle with a pair of perpendicularly trending inner walls.

Structurally, the clamp 12 includes an L-shaped member 16, which L-shaped member has an elongated longitudinal leg 18 and generally perpendicular thereto a foot 20 having a removed end 28 thereon. It may also be seen that Applicant's clamp 12 includes an upright 22 spaced apart but generally parallel to the foot, the upright having a first end 22A and second end 22B, the second end 22B including a threaded portion 23. Upright 22 with the threaded portion is spaced apart but longitudinally aligned with the removed end of foot 20. Thus, when a threaded adjuster 24 such as that illustrated is threadably engaged with threaded portion 23 of the upright, means are provided for applying compression to a workpiece.

It is seen that threaded adjuster 24 has a longitudinal axis and includes a threaded body 26, a head 28, and a base 30. It is seen that the head 28 is on the foot side of the threaded portion 23 of upright 22 and that base 30 is opposite. Moreover, Applicant's base 30 includes outer walls dimensioned in a generally polygonal shape. Furthermore, Applicant's assembly 10 includes a handle 14, the handle 14 includes handle body 30. It is seen that Applicant's handle has outer walls 32. Applicant's handle includes one or more sets of inner walls, which sets of inner walls define cavities and which inner walls are designed to slidably and snuggly engage base 30 of threaded adjuster 24.

Figure 6:
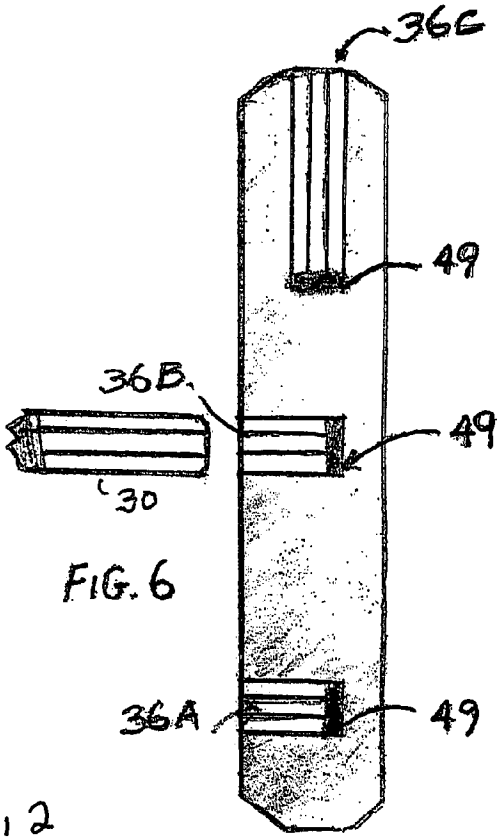
FIG. 6 is a cutaway section along the longitudinal axis of the handle.

It is seen with reference to FIGS. 1 and 6, for example, that Applicant's handle includes inner walls 36A and/or inner walls 36B and/or inner walls 36C.

Figure 5:
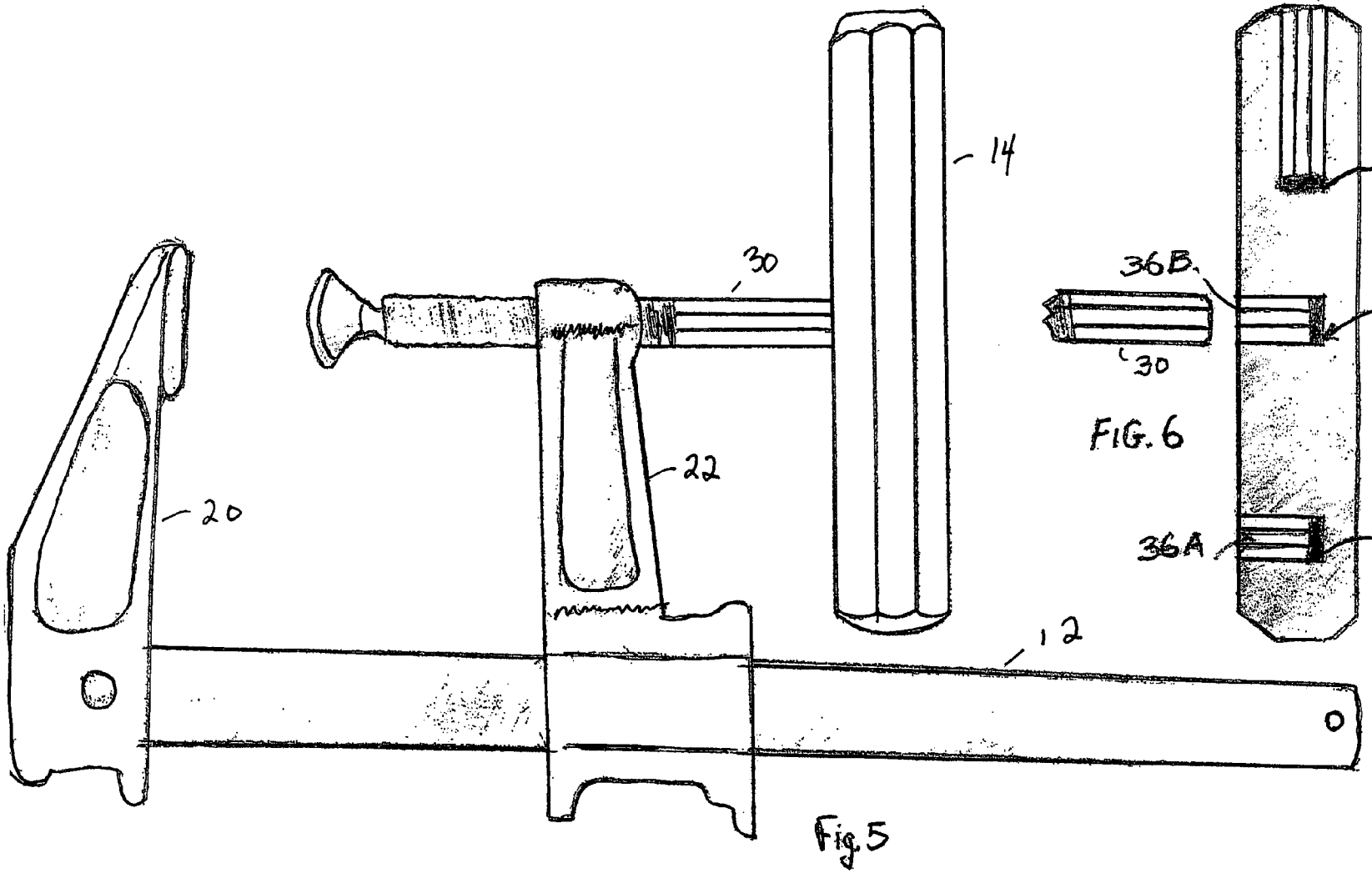
FIG. 5 illustrates Applicant's clamping assembly with the base engaged with inner walls 36A of handle.

Inner walls 36A and 36B define cavities that have longitudinal axis generally perpendicular to longitudinal axis of the handle and may engage the base so that the longitudinal axis of the handle is perpendicular to the base as illustrate, for example, in FIG. 5. This provides a means to slidably, toollessly engage the handle to the base so that the handle may be positioned in up to three different positions.

In a first position where the handle engages the base through the engagement of inner walls 36A as illustrated in FIG. 5, it is seen that the handle can be easily grasped and torque can be provided to the handle to rotate the threaded adjuster. However, it is also seen that the handle may engage the base at inner walls 36B and thus provide greater torque (greater moment arm) on the threaded adjuster and may be used where greater torque is required. Finally, walls 36C may be utilized to slidably engage the base and thus align the longitudinal axis of the cavity defined by inner walls 36C with the longitudinal axis of the base. This position would provide, however, less torque than that provided in the engaged positions of the handle with the base illustrate for inner walls 36A and 36B.

Thus, Applicant's invention can provide for a combination of one or more of up to three sets of walls and a handle, which handle may be made of, for example, steel, wood, plastic, nylon, or any other suitable material.

In addition, Applicant's assembly 10 may include a drill 38 such as a cordless drill, drill bit 40, and a socket 42, which socket is dimensioned to receive the drill bit when the drill bit is seated in the drill and which includes inner walls than can slidably and snuggly engage the base, so that electrical power may drive the threaded adjuster towards the closing or opening position. Use of a drill, socket, and drill bit including a drill with a torque adjustment feature thereon, may allow one to rapidly secure a number of clamps, with the handle removed therefrom, which handle may then be slidably engaged in one of the three positions to make final "fine" torque adjustments to the workpiece.

FIG. 6 is a cross-section of the handle. It shows the position of Applicant's body inner walls 36A, 36B, and 36C, along with the use of a magnet 49 near the end of the inner walls, which magnet will help hold the handle to the base when the handle is engaged with the base along inner walls.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

The invention claimed is:

1. An assembly for clamping a workpiece, the assembly comprising:

a clamp having an L-shaped member, the L-shaped member including a leg and a foot portion, the clamp having an upright extending generally perpendicular to the leg, the upright including a threaded portion, the clamp including a threaded adjuster having a head, a threaded body, and a base, the base including outer walls defining a polygon and a handle, the handle having spaced apart ends thereon, the handle having outer walls and inner walls, the inner walls dimensioned to removably, slideably and snugly engage the outer walls of the base.

2. The assembly of claim 1, further including a drill.

3. The assembly of claim 2, further including a drill bit for engaging the drill and a socket, the socket adapted to receive the drill bit for engaging the drill at a first end thereof and the base at a second end thereof, when the handle is removed therefrom.

4. The assembly of claim 1, wherein the upright and the leg are adapted to be slideably engaged.

5. The assembly of claim 4, further including a drill.

6. The assembly of claim 5, further including a drill bit for engaging the drill and a socket, the socket adapted to receive the drill bit for engaging the drill at a first end thereof and the base at a second end thereof, when the handle is removed therefrom.

7. The assembly of claim 1, wherein the upright and the leg are integral with one another and the upright is located at the removed end of the leg.

8. The assembly of claim 7, further including a drill.

9. The assembly of claim 8, further including a drill bit for engaging the drill and a socket, the socket adapted to receive the drill bit for engaging the drill at a first end thereof and the base at a second end thereof, when the handle is removed therefrom.

10. The assembly of claim 1, wherein the inner walls of the handle define a longitudinal cavity opening at a removed end thereof.

11. The assembly of claim 10, further including a drill.

12. The assembly of claim 11, further including a socket, the socket adapted to receive the drill bit for engaging the drill at a first end thereof and the base at a second end thereof, when the handle is removed therefrom.

13. The assembly of claim 10, wherein the upright and the leg are adapted to be slideably engaged.

14. The assembly of claim 10, wherein the upright and the leg are integral to one another and the upright is located at the removed end of the leg.

15. The assembly of claim 1, wherein the inner walls of the handle define a first transverse cavity with an opening located between the spaced apart ends of the handle.

16. The assembly of claim 15, further including a drill.

17. The assembly of claim 16, further including a drill bit for engaging the drill and a socket, the socket adapted to receive the drill bit for engaging the drill at a first end thereof and the base at a second end thereof.

18. The assembly of claim 15, wherein the upright and the leg are adapted to be slideably engaged.

19. The assembly of claim 15, wherein the upright and the leg are integral and the upright is located at the removed end of the leg.

20. An assembly for clamping a workpiece, the assembly comprising:

a clamp having an L-shaped member, the L-shaped member including a leg and a foot portion, the clamp having an upright extending generally perpendicular to the leg, the upright including a threaded portion, the clamp including a threaded adjuster having a head, a threaded body, and a base, the base including outer walls defining a polygon and a handle, the handle having spaced apart ends thereon, the handle having outer walls and inner walls, the inner walls dimensioned to removably, slideably and snugly engage the outer walls of the base; the inner walls including transverse walls, and a magnet at the end of a cavity defined by the inner walls, further including a drill, a drill bit for engaging a drill, and a socket, the socket adapted to receive the drill bit at a first end thereof and the base at a second end thereof, when the handle is removed therefrom; wherein the upright end of the leg are slidably engaged one to the other.

* * * * *